United States Patent [19]

Knapp et al.

[11] Patent Number: 4,477,027

[45] Date of Patent: Oct. 16, 1984

[54] ELECTROMAGNETICALLY ACTUATABLE VALVE, IN PARTICULAR A FUEL INJECTION VALVE FOR FUEL INJECTION SYSTEMS

[75] Inventors: Heinrich Knapp, Leonberg; Rudolf Sauer, Benningen; Rudolf Krauss, Stuttgart; Udo Hafner, Lorch, all of Fed. Rep. of Germany

[73] Assignee: Robert Bosch GmbH, Stuttgart, Fed. Rep. of Germany

[21] Appl. No.: 378,453

[22] Filed: May 14, 1982

[30] Foreign Application Priority Data

May 21, 1981 [DE] Fed. Rep. of Germany ..... 3120160

[51] Int. Cl.[3] ..... F02M 51/00

[52] U.S. Cl. ..... 239/585; 251/139

[58] Field of Search ..... 239/585, 584, 583, 590, 239/533.11, 124, 125; 251/140, 141, 139

[56] References Cited

U.S. PATENT DOCUMENTS 3,241,768 3/1966 Croft ..... 239/124

4,350,301 9/1982 Erwin et al. ..... 239/584

4,365,747 12/1982 Knapp et al. ..... 239/585 X

*Primary Examiner*—Andres Kashnikow

*Assistant Examiner*—James R. Moon, Jr.

*Attorney, Agent, or Firm*—Edwin E. Greigg

[57] ABSTRACT

An electromagnetically actuatable valve which serves in particular to inject fuel into the intake tube of internal combustion engines operating with fuel injection. The fuel injection valve includes a valve housing, a shell core with a magnetic winding, and a flat armature which is firmly connected to a valve element having a tubular section and a spherical section. A guide diaphragm attached to the housing engages a guide edge of the flat armature in an elastic manner and guides the flat armature parallel to the end face of the shell core. The coaxial guidance of the spherical section relative to the valve seat is effected by means of guide faces of a guide ring. As a result, the movable valve element can have an elongated embodiment, and the fuel injection can be effected at any desired location of the intake tube, while the valve simultaneously requires little installation space.

5 Claims, 2 Drawing Figures

ELECTROMAGNETICALLY ACTUATABLE VALVE, IN PARTICULAR A FUEL INJECTION VALVE FOR FUEL INJECTION SYSTEMS

BACKGROUND OF THE INVENTION

The invention is based on an electromagnetically actuatable valve and more particularly a fuel injection valve for fuel injection systems of internal combustion engines, having a valve housing, a core having an end face, a magnetic winding and an armature, said armature being firmly connected with a valve element cooperating with a fixed valve seat and guided parallel to the end face of the core by a guide diaphragm clamped to the housing on its outer circumference, and further wherein the guide diaphragm rests under spring tension on a concentric guide edge on the side of the armature oriented toward the valve seat. An electromagnetically actuatable valve is already known in which the armature is guided parallel by a guide diaphragm, which at its circumference is attached to the housing. A central guide opening of the guide diaphragm surrounds and engages a valve element firmly connected to the armature, centering it in a radial direction. Because of the required tolerance, centering the valve by means of the central guide opening of the guide diaphragm permits the use only of valve elements which are relatively short in a axial direction, because if the valve element is elongated in the axial direction, the radial eccentricity of the valve element relative to the valve seat becomes undesirable. The required shortness of the valve element in this known valve has the disadvantage that, because the ejection location is relatively close to the valve housing, a great deal of space in the radial direction is required for installing the valve. Thus if this valve is disposed at the intake tube of an internal combustion engine, and especially if it is disposed near the inlet valves of the individual engine cylinders, there can be difficulties in installing it.

OBJECT AND SUMMARY OF THE INVENTION

The valve according to the invention has the advantage over the prior art that the armature is guided in a low-friction and plane-parallel manner and that the valve element is centered in an advantageous manner. As a result, the invention enables a required lengthening of the valve element in the axial direction, so that the valve end can be slender in embodiment in the vicinity of the valve seat and valve element. On the one hand, less space is required for installing the valve, and on the other hand, if the valve is used as a fuel injection valve, it is possible for fuel to be injected at any desired location in the intake tube.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
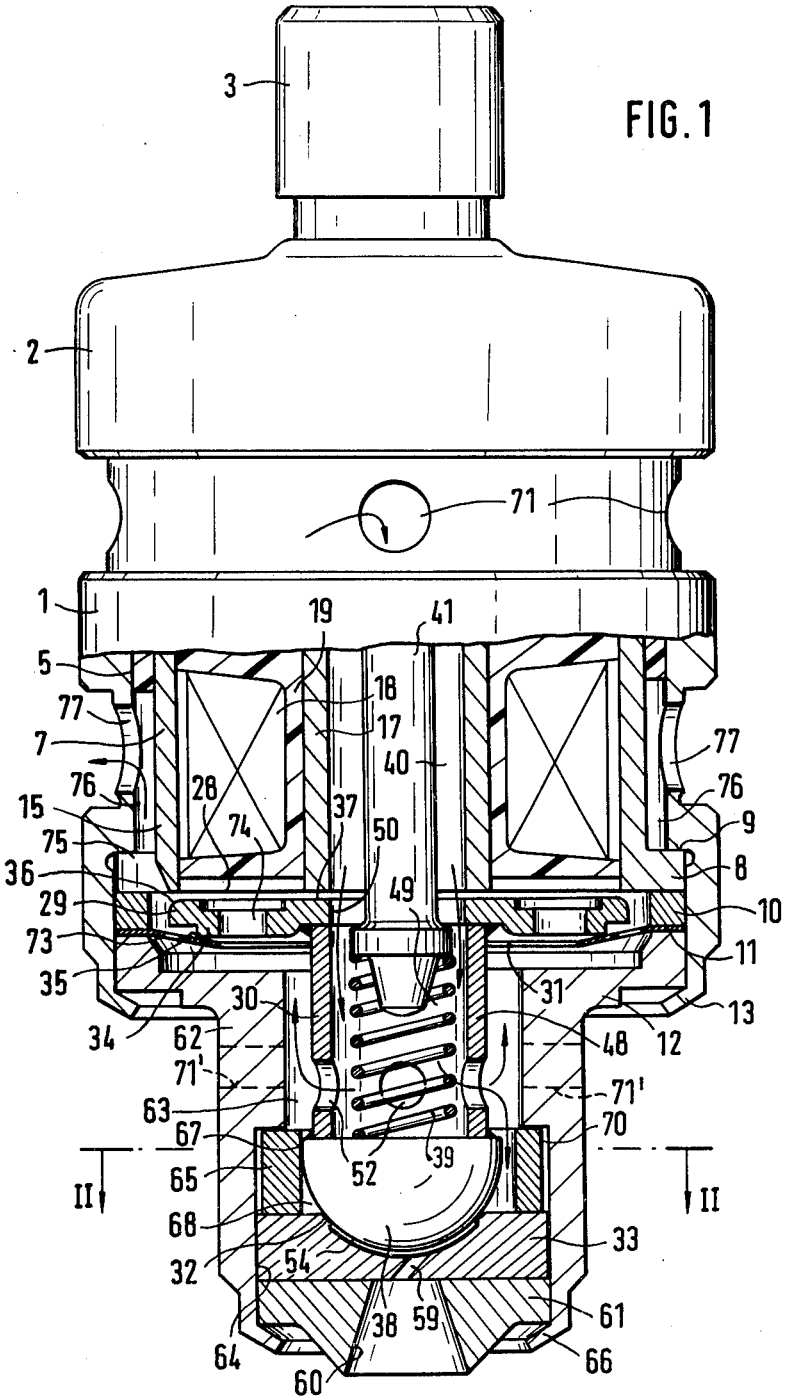
FIG. 1 shows an electromagnetically actuatable fuel injection valve in partial cross section.

The fuel injection valve shown in FIG. 1 and intended for a fuel injection system serves by way of example for the injection of fuel, especially at low pressure, into the intake tube of mixture-compressing internal combustion engines with externally-supplied ignition. A valve housing 1 is fabricated by some method not producing chips, for instance, deep drawing, rolling or the like. It has a cup-like shape with a base 2, beginning at which there is a tubular guide fitting 3. A shell-type core 7 of ferromagnetic material is inserted into the interior 5 of the valve housing 1; the core 7 has a diameter smaller than that of the interior 5 and rests with a shoulder 8 on an inner step 9 of the valve housing 1. The side of the shoulder 8 remote from the inner step 9 is engaged by a spacer ring 10, which is followed by a guide diaphragm 11 and a nozzle carrier 12. A crimped edge 13 partially surrounds the end face of the nozzle carrier 12, engaging it and exerting axial tension on it so as to assure the positional fixation of the shell core 7, the spacer ring 10, the guide diaphragm 11 and the nozzle carrier 12. A conventional shell core available on the market from Siemens and known as T 26 can be used for the shell core 7; this element has an annular outer core 15 an annular inner core 17 connected therewith via a crosspiece 16. A magnetic winding 18 may be at least partially enclosed by an insulating carrier body 19, which together with the magnetic winding 18 is inserted into the annular space of the shell core 7 formed between the outer core 15 and the inner core 17 and is connected in a positively engaged manner with the crosspiece 16.

A flat armature 29 is disposed between an end face of the shell core 7 and the guide diaphragm 11. A movable valve element 30 is connected, for instance by soldering or welding, with the middle area of the flat armature 29. The valve element 30 passes through a central guide opening 31 in the guide diaphram 11 without touching it and cooperates with a fixed valve seat 32 formed in a valve seat body 33. The valve seat body 33 is guided in the nozzle carrier 12. The guide diaphragm 11 is rigidly connected neither with the valve element 30 nor with the flat armature 29. The flat armature 29 may be embodied as a stamped or press-cast element and may by way of example have an annular guide ring 34 oriented toward the guide diaphragm 11. First, the guide ring 34 improves the rigidity of the flat armature 29; second, it separates a first work zone 36 of the flat armature, which is oriented toward the end face of the outer core 15, from a second work zone 37, which is oriented toward the end face of the inner core 17; and third, it forms a concentric guide edge 35 which rests on the guide diaphragm 11, as a result of which the flat armature 29 is guided in a plane parallel to the end face 28 of the shell core 7.

The valve element 30 has a spherical section 38 cooperating with the valve seat 32. When the valve element 30 is resting on the valve seat 32, the guide diaphragm 11, drawn into a curve by the tension exerted on it, rests on the guide edge 35 of the flat armature 29. The valve element 30 is urged in the closing direction of the valve by a compression spring 39, which on the other end is supported on a slide member 41, which protrudes through an inner bore 40 of the shell core 7. The force of the compression spring 39 exerted on the flat armature 29 and the valve element 30 can be influenced by axially displacing the slide member 41.

On its end remote from the flat armature, the slide member 41 is pressed into the guide fitting 3. When the valve element 30 is resting on the valve seat 32, the guide diaphragm 11, drawn into a curve by the tension exerted on it, rests on the guide edge 35 of the flat armature 29. The valve element 30 is urged in the closing direction of the valve by a compression spring 39, which on the other end is supported on a slide member 41, which protrudes through an inner bore 40 of the shell core 7. The force of the compression spring 39 exerted on the flat armature 29 and the valve element 30 can be influenced by axially displacing the slide member 41.

On its end remote from the flat armature, the slide member 41 is pressed into the guide fitting 3. Spin conduits 59 (only one of which is shown ) lead away from a spin chamber 60 toward the collector chamber 54 and in a known manner may be inclined at an angle relative to the valve axis. The spin conduits 59 may discharge into the spin chamber 60 at a tangent, for example, and they serve the purpose of metering fuel. The fuel film forming on the wall of the spin chamber 60, which is embodied inside a spin body 61, rips off at the sharply-pointed end of the spin chamber 60, which discharges into the intake tube, and thus enters the air flow of the intake tube in a conical pattern; as a result, particularly at low fuel pressures, good fuel preparation is assured.

Figure 2:
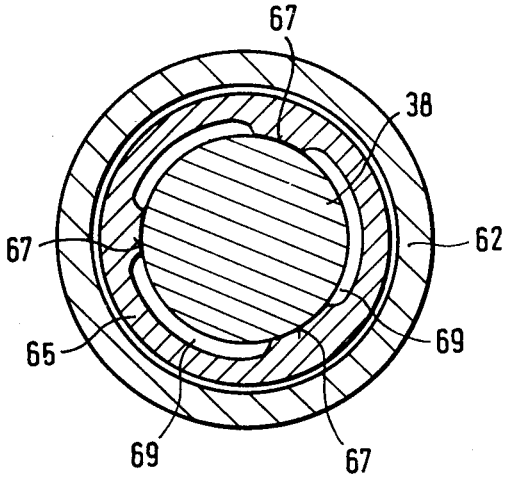
FIG. 2 is a section taken along the line II—II of FIG. 1.

An extension section 62 of the nozzle carrier 12 having a substantially smaller diameter than the diameter of the valve housing 1 protrudes beyond the crimped edge 13 and has a flow bore 63 in the axial direction as well as a reception bore 64, remote from the crimped edge 13, of a greater diameter. A guide ring 65, the valve seat body 33 and the spin body 61 are inserted one behind the other into the reception bore 64 and fixed in position around the spin body 61 by means of a crimping 66 of the end of the extension section 62. The movable valve element 30 passes with a lesser diameter through the flow bore 63 and is guided in the radial direction by guide faces 67 of a guide opening 68 embodied in the guide ring 65. As shown in FIG. 2, at least three guide faces 67 are provided, spaced apart by approximately equal distances from one another; in the present instance, they are offset by ca. 120° from one another. Flow recesses 69 are provided in the axial direction between the individual guide faces 67. The outside diameter 70 of the guide ring 65 is smaller than the diameter of the reception bore 64. As a result, during the assembly of the unit and after the guide ring 65, the valve seat body 33 and the spin body 61 have been placed into the reception bore 64, it is possible for the guide ring 65 to be automatically centered in the radial direction, resting on the circumference of the spherical section 38, and only subsequently to be fixed in this position by means of the crimping 66.

The delivery of fuel to the fuel injection valve may be effected via inflow openings 71 provided on the circumference of the valve housing 1. From there, the fuel flows into the inner bore 40 and then via the opening 50 in the flat armature 29, the blind bore 49 in the movable valve element 30 and the transverse bores 52 into the flow bore 63. From the flow bore 63, the fuel can flow on the one hand via the flow recesses 69 in the guide ring 65 to the valve seat 32 and, when the valve is open, it can be ejected via the collector chamber 54, the spin conduits 59 and the spin chamber 60. On the other hand, the non-metered portion of the fuel can flow out of the flow bore 63 via the opening 31 or discharge openings 73 of the guide diaphragm 11 and discharge openings 74 in the flat armature 29 to openings 75 in the shoulder 8 of the shell core 7, which lead to an annular flow conduit 76. The flow conduit 76 is defined on one side by the outer circumference of the shell core 7 and on the other side by the inside diameter of the valve housing. From the flow conduit 76, discharge openings 77 provided in the wall of the valve housing 1 flow to a fuel return-flow line, not shown.

Instead of flowing by way of the inlet openings 71, the fuel can also flow in via inlet openings 71' in the extension section 62 as indicated by broken lines.

The radial guidance of the movable valve element 30 by means of the guide ring 65 enables an elongated, slender embodiment of the valve element 30, so that fuel injection can be effected at any desired location of the intake tube, while at the same time the extension section 62 is slender in embodiment; as a result, less space is required at the intake tube for installing the valve.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electromagnetically actuatable valve, particularly a fuel injection valve for fuel injection systems of internal combustion engines, having a valve housing, a core having an end face, a magnetic winding and an armature, said armature being firmly connected with a valve element cooperating with a fixed valve seat and guided parallel to said end face of said core by a guide diaphragm clamped to said housing on its outer circumference, and further wherein said guide diaphragm rests under spring tension on a concentric guide edge of said armature on the side of said armature oriented toward said valve seat, said valve element having a tubular section secured at one end to said armature, said tubular section extending through said diaphragm free of any contact therewith and including a spherical end section secured thereto which cooperates with said valve seat, a guide ring juxtaposed said valve seat including a guide opening into which said valve element protrudes, and said guide opening guides said valve element coaxial relative to said valve seat.

2. A valve as defined by claim 1, characterized in that the guidance of said valve element is effected in the guide ring by means of guide faces of said guide opening.

3. A valve as defined by claim 2, characterized in that at least three guide faces are provided on said guide ring, said faces being spaced apart from one another by approximately equal distances.

4. A valve as defined by claim 3, characterized in that said guide faces are provided with flow recesses which extend in an axial direction.

5. A valve as defined by claim 1, characterized in that said guide ring has an outside diameter which is smaller than a reception bore which is arranged to receive said guide ring.

* * * * *